US012098891B1

(12) United States Patent
Alshareef

(10) Patent No.: US 12,098,891 B1
(45) Date of Patent: Sep. 24, 2024

(54) SHELL-AND-TUBE HEAT EXCHANGER WITH SEMICYLINDRICAL TUBES

(71) Applicant: GIFTEDNESS AND CREATIVITY COMPANY, Safat (KW)

(72) Inventor: Sultan M. S. M. Z. Alhamed Alshareef, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 18/233,500

(22) Filed: Aug. 14, 2023

(51) Int. Cl.
*F28D 7/16* (2006.01)

(52) U.S. Cl.
CPC ..... *F28D 7/16* (2013.01)

(58) Field of Classification Search
CPC ..... F28D 7/16; F28D 7/1684
USPC ..... 165/157
See application file for complete search history.

(56) References Cited

U.S. PATENT DOCUMENTS 3,306,351 A * 2/1967 Vollhardt ..... B01D 51/10 165/145
4,332,294 A * 6/1982 Drefahl ..... F28F 1/06 165/157
5,400,854 A * 3/1995 Iio ..... F28F 9/001 165/157
8,069,905 B2 * 12/2011 Goto ..... F28D 7/1653 165/145
9,127,896 B1 * 9/2015 Nehlen, III ..... B01D 29/012
11,680,530 B1 * 6/2023 Owoeye ..... F02C 7/36 415/1
2015/0000881 A1 * 1/2015 Tamura ..... F28F 13/187 165/157
2016/0146542 A1 * 5/2016 Veilleux, Jr. ..... F28D 7/106 165/157

FOREIGN PATENT DOCUMENTS

IN 201941049387 A * 12/2019

* cited by examiner

*Primary Examiner* — Raheena R Malik
(74) *Attorney, Agent, or Firm* — Nath, Goldberg & Meyer; Joshua B. Goldberg

(57) ABSTRACT

The shell-and-tube heat exchanger with semicylindrical tubes includes a shell, an inlet tube sheet received within the shell, and an outlet tube sheet received within the shell. The inlet tube sheet divides the interior of the shell into an inlet plenum and a heat exchange region, and the outlet tube sheet further divides the interior of the shell into an outlet plenum and the heat exchange region. A plurality of tubes are received in and extend across the heat exchange region within the shell. Each of the tubes has an inlet end and an outlet end respectively mounted within corresponding openings formed through the inlet and outlet tube sheets. Each of the tubes is in fluid communication with the inlet plenum and the outlet plenum, and each of the tubes has a semicylindrical shape.

3 Claims, 6 Drawing Sheets

SHELL-AND-TUBE HEAT EXCHANGER WITH SEMICYLINDRICAL TUBES

BACKGROUND OF THE INVENTION

Field of the Invention

The disclosure of the present patent application relates to heat exchangers, and particularly to a shell-and-tube heat exchanger with semicylindrical-shaped tubes.

Description of Related Art

A shell-and-tube heat exchanger is a type of heat exchanger which includes a "shell" (i.e., a large pressure vessel) and a bundle of tubes which extend within the shell. The shell-and-tube heat exchanger is the most common type of heat exchanger in oil refineries and other large chemical processes. This type of heat exchanger is well suited for higher-pressure applications. In operation, one type of fluid runs through the tubes, and another fluid flows over and around the tubes (within the interior of the shell) to transfer heat between the two fluids. Heat is transferred from one fluid to the other through the tube walls, either from the tube side to the shell side or vice versa. The fluids can be either liquids or gases on either the shell or the tube side. In order to transfer heat efficiently, a large heat transfer area should be used, leading to the use of many tubes arrayed within the shell, thus increasing the heat transfer area.

FIG. 2 illustrates a typical shell-and-tube heat exchanger 100. An inlet tube sheet 104 and an outlet tube sheet 106 divide an interior of shell 102 into an inlet plenum 108, an outlet plenum 110 and a heat exchange region 112. Inlet ends 116 of tubes 114 are mounted within openings 118 formed through the inlet tube sheet 104 such that the inlet ends 116 communicate with the inlet plenum 108. Similarly, outlet ends 120 of tubes 114 are mounted within openings 122 formed through the outlet tube sheet 106 such that the outlet ends 120 communicate with the outlet plenum 110. The inlet plenum 108 has a tube inlet 124 for receiving the first fluid which will enter the tubes 114. Following heat exchange with the second fluid inside the heat exchange region 112, the first fluid enters the outlet plenum 110 and is released through a tube outlet 126. The shell 102 has shell inlet 128 and a shell outlet 130. The second fluid enters through the shell inlet 128 and, following heat exchange with the first fluid in the heat exchange region 112, exits the shell through the shell outlet 130.

In addition to the above, shell-and-tube heat exchangers, such as shell-and-tube heat exchanger 100 of FIG. 2, often include baffles 132, which direct flow through the shell side so the second fluid does not take a short cut through the shell side, which would result in ineffective low flow volumes. Baffles 132 also serve to introduce turbulence into the flow of the second fluid in order to maximize contact with the outer surfaces of tubes 114. Baffles 132 are typically attached to the tube bundle 114 rather than the shell 102 so that the tube bundle 114 remains easily removable for maintenance.

However, baffles, such as baffles 132 in FIG. 2, add a large amount of weight to the shell-and-tube heat exchanger, thus requiring additional effort and time for the assembly, maintenance and transport of the heat exchanger. It would be desirable to be able to enhance contact between the second fluid and the outside of the tubes to benefit from enhanced heat transfer rates, as when baffles are used, but without requiring the addition of baffles to the shell-and-tube heat exchanger. In addition to the removal of baffles, if the overall thermal performance of the tubes could be increased, and the drag force on the fluid flowing around the tubes could be decreased, the overall size of the shell-and-tube heat exchanger could be decreased without losing overall efficiency. Similarly, the required fluid pressures could also be decreased without losing overall efficiency. Thus, a shell-and-tube heat exchanger with semicylindrical tubes solving the aforementioned problems is desired.

SUMMARY OF THE INVENTION

The shell-and-tube heat exchanger with semicylindrical tubes of the present disclosure includes a shell, an inlet tube sheet received within the shell, and an outlet tube sheet received within the shell. The inlet tube sheet divides the interior of the shell into an inlet plenum and a heat exchange region, and the outlet tube sheet further divides the interior of the shell into an outlet plenum and the heat exchange region. A tube inlet is formed through the shell such that the tube inlet is in fluid communication with the inlet plenum for feeding a first fluid thereto. A tube outlet is formed through the shell such that the tube outlet is in fluid communication with the outlet plenum for releasing the first fluid therefrom following heat exchange between the first fluid and a second fluid.

A plurality of tubes are received in and extend across the heat exchange region within the shell. Each of the tubes has an inlet end and an outlet end respectively mounted within corresponding openings formed through the inlet and outlet tube sheets. Each of the tubes is in fluid communication with the inlet plenum and the outlet plenum, and each of the tubes has a semicylindrical shape.

In use, the second fluid is fed into the heat exchange region through a shell inlet formed through the shell. The shell inlet is in fluid communication with the heat exchange region. The second fluid is released from the heat exchange region through a shell outlet formed through the shell following the heat exchange between the first fluid and the second fluid. The shell outlet is in fluid communication with the heat exchange region. The plurality of tubes are provided in pairs, with each of the pairs of tubes including first and second tubes positioned adjacent to each other such that a gap is formed therebetween. It is contemplated that the gap is formed between planar surfaces of the first and second tubes in each of the pairs of tubes. Thus, during heat exchange, the second fluid flows both through the gaps and completely around each of tubes in the pairs of tubes.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
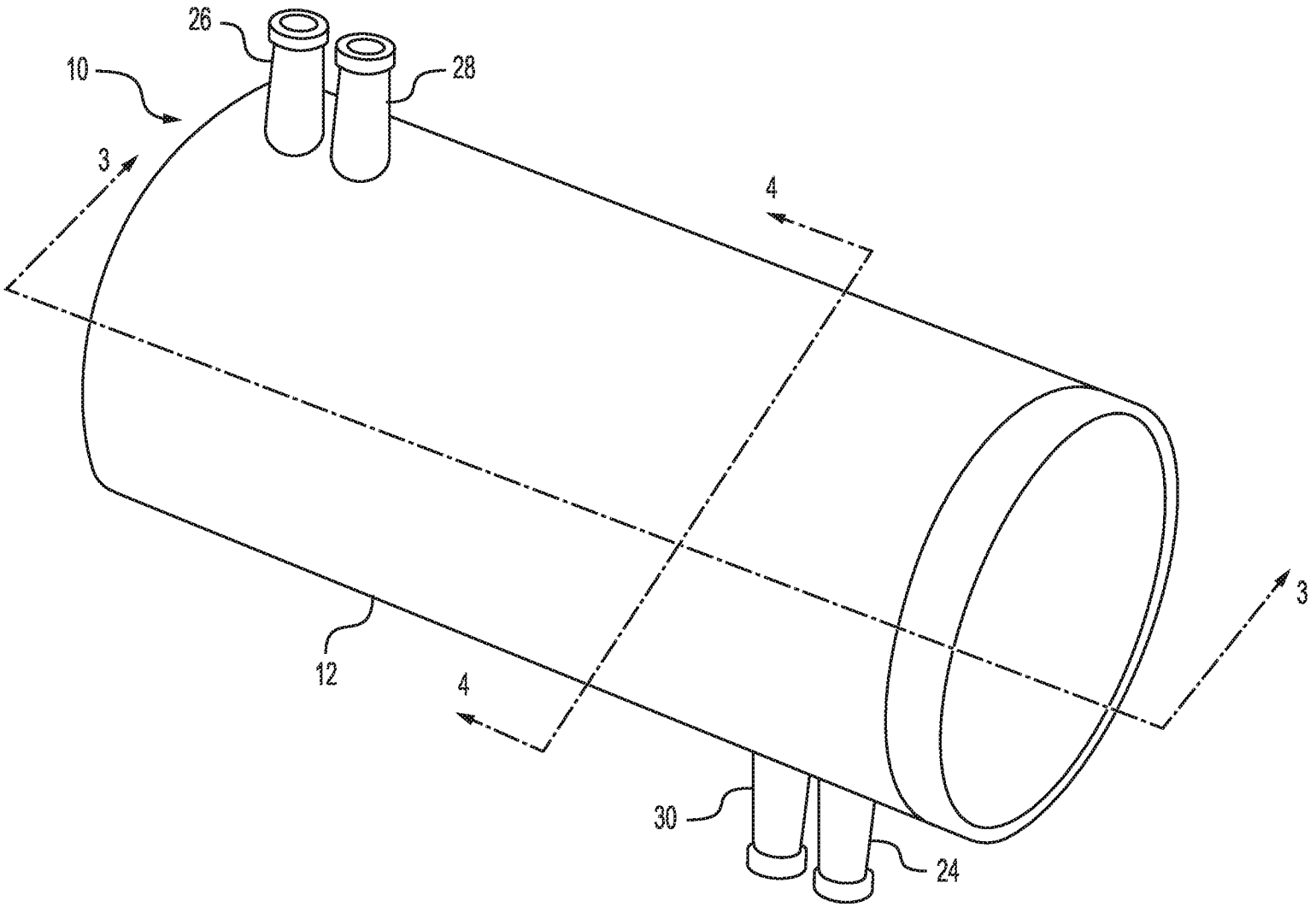
FIG. 1 is a perspective view of a shell-and-tube heat exchanger with semicylindrical tubes.
Figure 2:
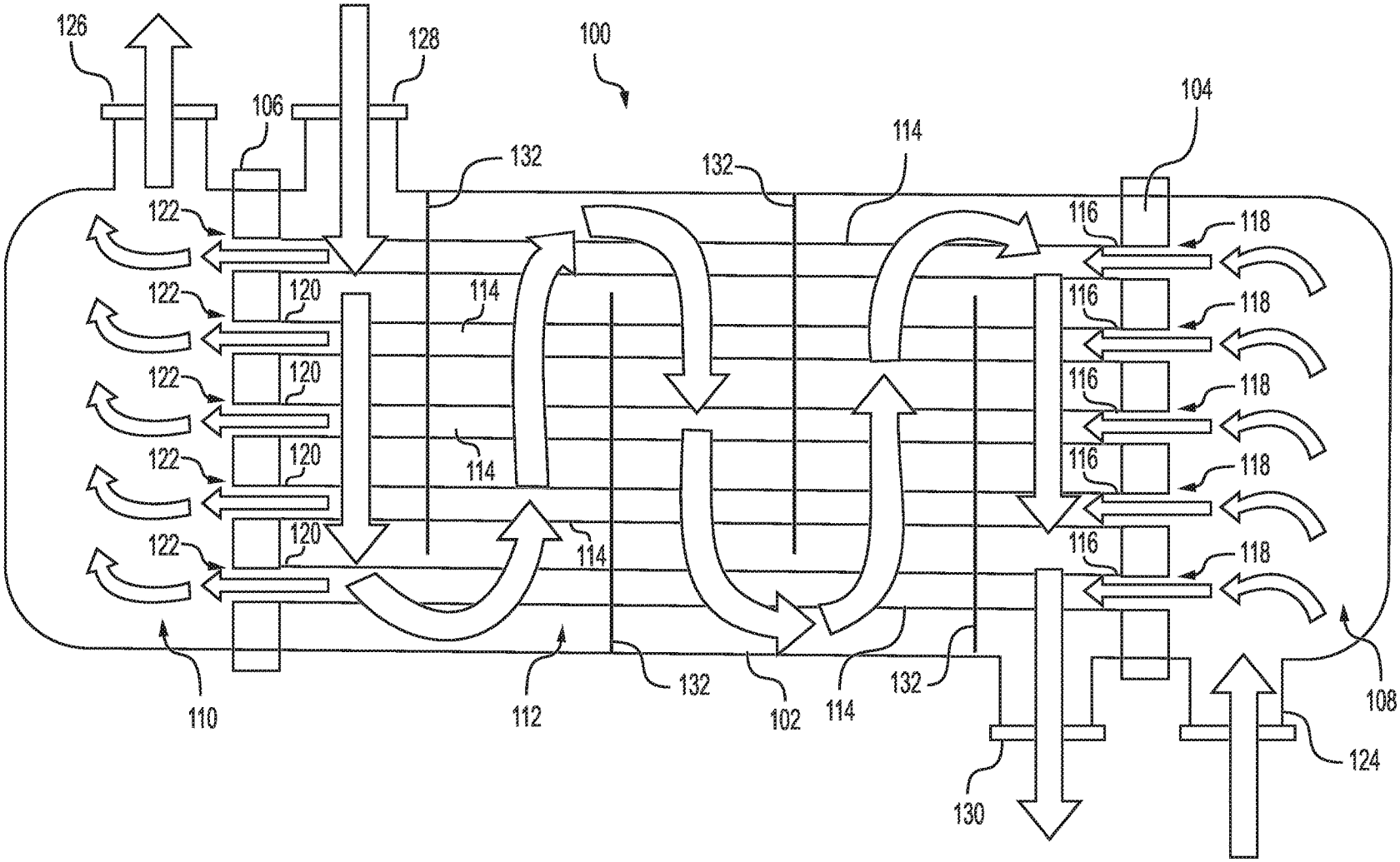
FIG. 2 PRIOR ART
FIG. 2 diagrammatically illustrates a conventional shell-and-tube heat exchanger.
Figure 3:
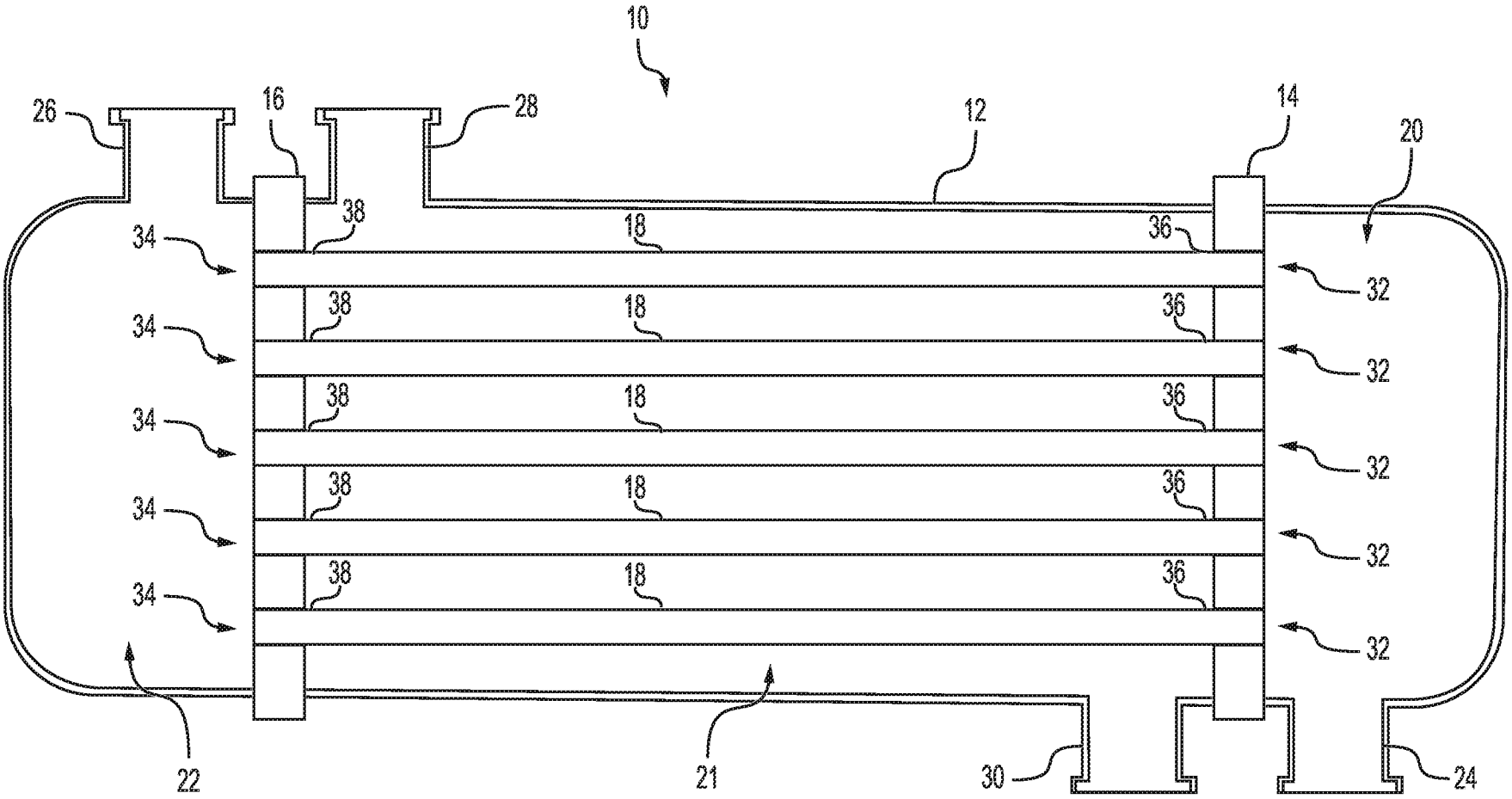
FIG. 3 is a cross-sectional view of the shell-and-tube heat exchanger with semicylindrical tubes of FIG. 1 taken along cross-sectional cut lines 3-3.

Referring now to FIGS. 1 and 3, the shell-and-tube heat exchanger with semicylindrical tubes 10 includes a shell 12, an inlet tube sheet 14 received within the shell 12, and an outlet tube sheet 16 received within the shell 12. Similar to the conventional shell-and-tube heat exchanger 100 described above with respect to FIG. 2, the inlet tube sheet 14 divides the interior of the shell 12 into an inlet plenum 20 and a heat exchange region 21, and the outlet tube sheet 16 further divides the interior of the shell 12 into an outlet plenum 22 and the heat exchange region 21, such that the heat exchange region 21 is positioned between the inlet plenum 20 and the outlet plenum 22, as shown. It should be understood that the overall shape and relative dimensions of the shell 12, the inlet plenum 20, the heat exchange region 21 and the outlet plenum 22 are shown for exemplary purposes only and may be varied. It should be further understood that the relative dimensions and positioning of the inlet tube sheet 14 and the outlet tube sheet 16 are shown in FIG. 3 for exemplary purposes only and may be varied.

Similar to the conventional shell-and-tube heat exchanger 100 described above with respect to FIG. 2, a tube inlet 24 is formed through the shell 12 such that the tube inlet 24 is in fluid communication with the inlet plenum 20 for feeding a first fluid into tube 18. Similarly, a tube outlet 26 is formed through the shell 12 such that the tube outlet 26 is in fluid communication with the outlet plenum 22 for releasing the first fluid from tube 18 following heat exchange between the first fluid and a second fluid within the heat exchange region 21. It should be understood that the overall configuration, shape and positioning of the tube inlet 24 and the tube outlet 26 are shown in FIGS. 1 and 3 for exemplary purposes only and may be varied.

A plurality of tubes 18 are received in and extend across the heat exchange region 21 within the shell 12. Each of the tubes 18 has an inlet end 36 and an outlet end 38 respectively mounted within corresponding openings 32, 34 formed through the inlet and outlet tube sheets 14, 16, respectively. The openings 32, 34 are shaped such that the respective ends of tubes 18 fit therein in a fluid-tight manner. Each of the tubes 18 is in fluid communication with the inlet plenum 20 and the outlet plenum 26, such that the first fluid entering the inlet plenum 20 through the tube inlet 24 flows through the tubes 18 and exits into the outlet plenum 22, where it is then released through the tube outlet 26. As will be discussed in greater detail below, each of the tubes has a semicylindrical shape; i.e., each of the tubes is provided in the form of a semicylindrical shell with axially-opposed open ends.

In use, the second fluid is fed into the heat exchange region 21 through a shell inlet 28 formed through the shell 12. The shell inlet 28 is in fluid communication with the heat exchange region 21. The second fluid is released from the heat exchange region 21 through a shell outlet 30 formed through the shell 12 following the heat exchange between the first fluid and the second fluid. The tubes 18 are thermally conductive, such that heat exchange can occur between the first fluid flowing through tubes 18 and the second fluid which is flowing through the heat exchange region 21 external to the tubes 18. The shell outlet 30 is in fluid communication with the heat exchange region 21. It should be understood that the overall configuration, shape and positioning of the shell inlet 28 and the shell outlet 30 are shown in FIGS. 1 and 3 for exemplary purposes only and may be varied.

Figure 4:
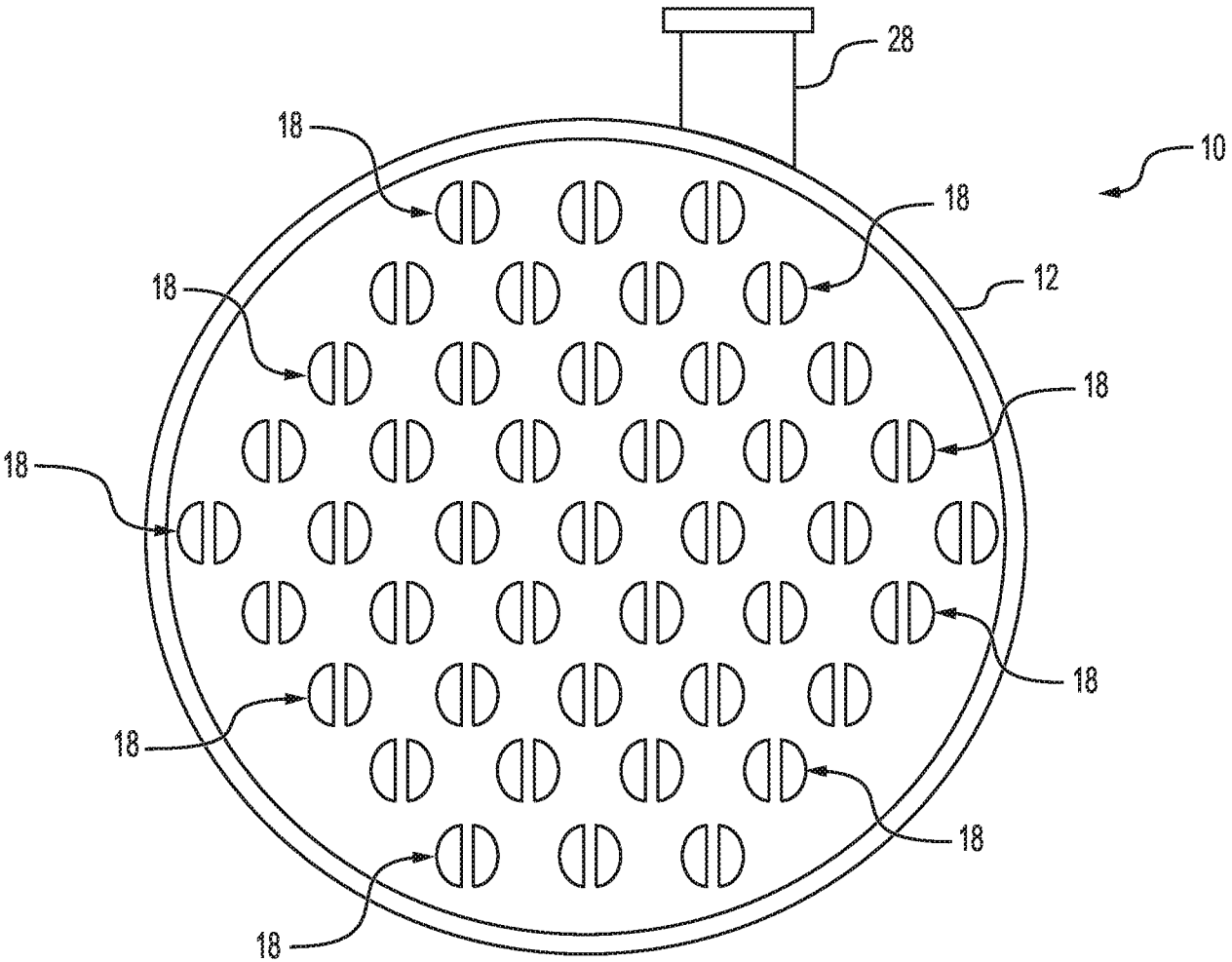
FIG. 4 is a cross-sectional view of the shell-and-tube heat exchanger with semicylindrical tubes of FIG. 1 taken along cross-sectional cut lines 4-4.
Figure 5:
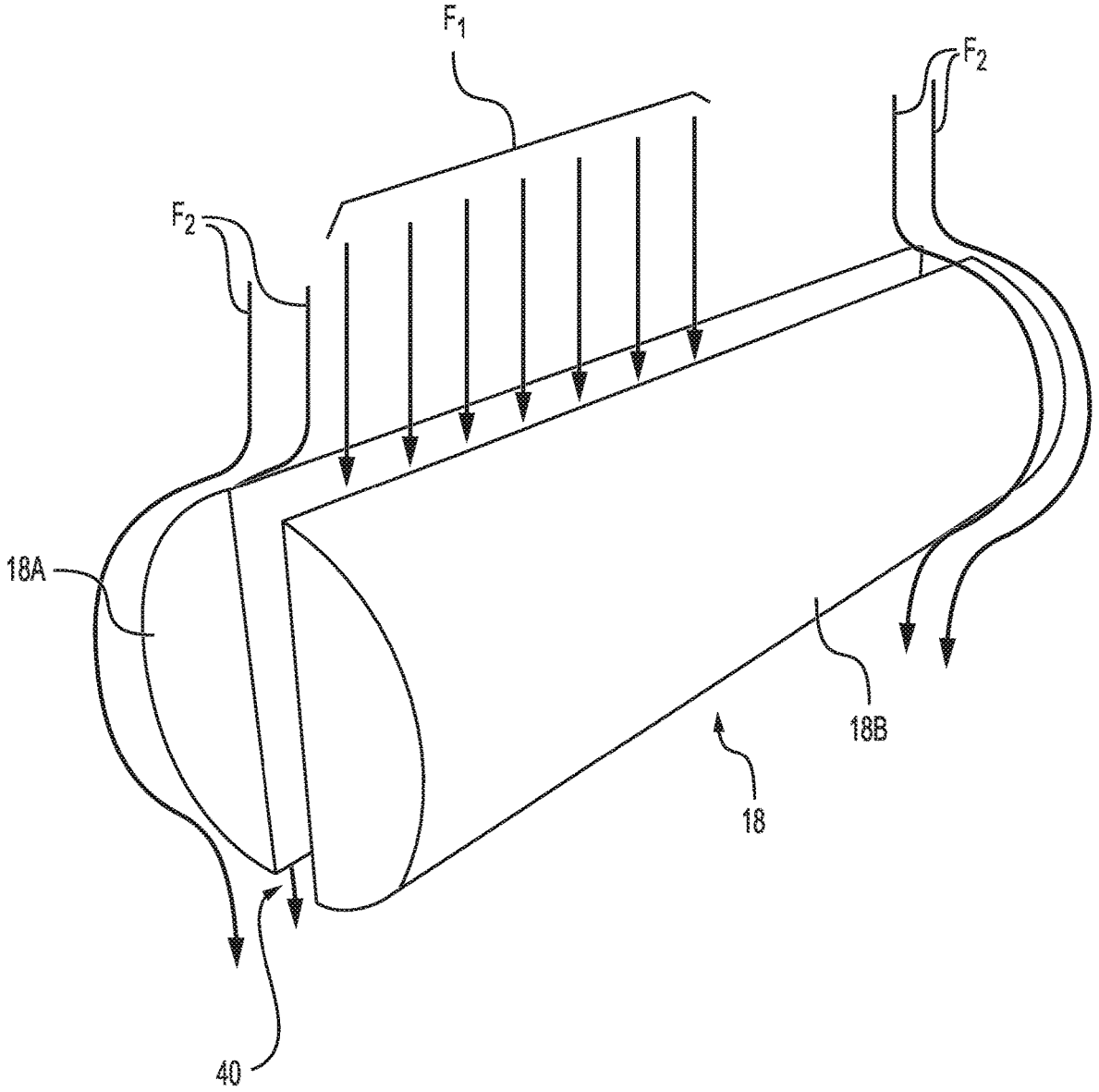
FIG. 5 is a perspective view of a pair of tubes of the shell-and-tube heat exchanger with semicylindrical tubes.

As shown in FIGS. 4 and 5, the plurality of tubes 18 are provided in pairs, with each of the pairs of tubes including first and second tubes 18A, 18B, respectively, positioned adjacent to each other such that a gap 40 is formed therebetween. In a particular configuration, the gap 40 is formed between planar surfaces of the semicylindrical first and second tubes 18A, 18B in each of the pairs of tubes 18, as shown in FIG. 5. Thus, during heat exchange, the second fluid flows both through the gaps 40 (shown as flow F1 in FIG. 5) and around the pairs of tubes (shown as flow F2 in FIG. 5). It should be understood that the particular arrangement of the pairs of tubes 18A, 18B shown in FIG. 4 is shown for exemplary purposes only and may be varied. However, it is noted that a staggered configuration, such as that illustrated in FIG. 4, introduces turbulent flow into the second fluid, resulting in an efficient heat transfer such as that produced when baffles are used (as in the conventional heat exchanger 100 shown in FIG. 2), but without the need for baffles.

Figure 6B:
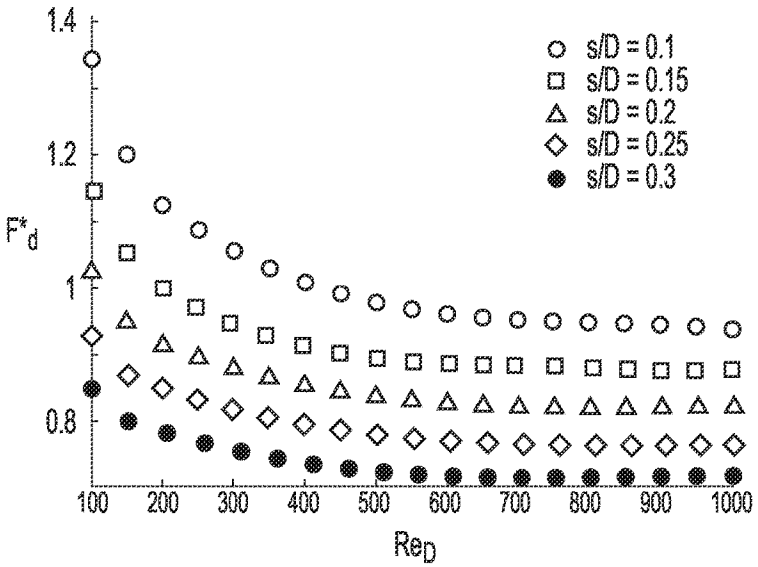
FIG. 6B is a plot of drag force on a fluid flowing around and between a pair of semicylindrical tubes as a function of gap size between the semicylindrical tubes.
Figure 6A:
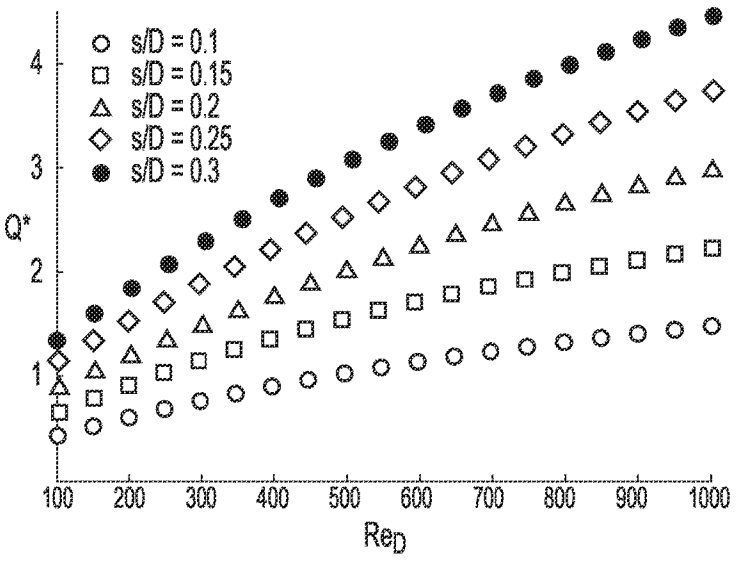
FIG. 6A is a plot of thermal performance of the shell-and-tube heat exchanger with semicylindrical tubes as a function of gap size between adjacent semicylindrical tubes.
Figure 6C:
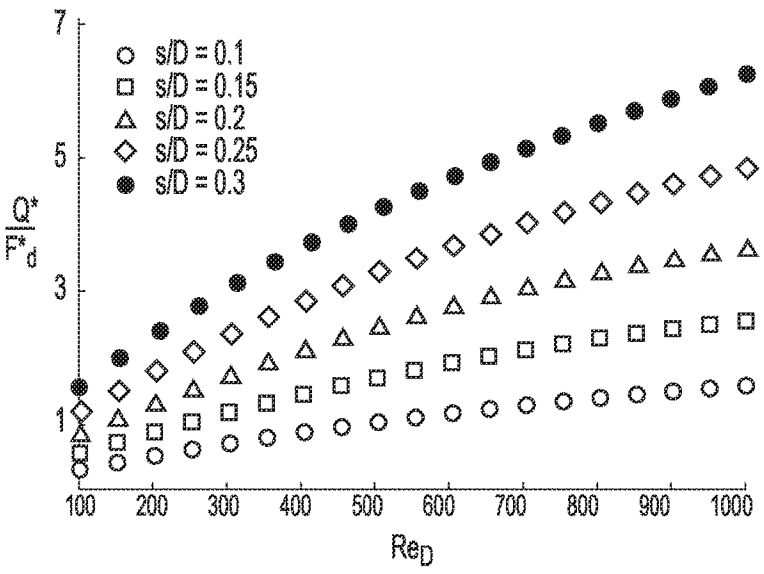
FIG. 6C is a plot showing the ratios of thermal performance of FIG. 6A and drag force of FIG. 6B for varying gap sizes.

It should be understood that the relative size of gap 40 is shown in FIG. 5 for exemplary purposes only and may be varied. However, as shown in FIGS. 6A, 6B and 6C, both the flow and thermodynamic properties of the shell-and-tube heat exchanger with semicylindrical tubes improve with an increased size of gap 40. In each of FIGS. 6A, 6B and 6C, $Q^*$ represents thermal performance, $F^*_d$ represents the drag force, s represents the size of the gap 40, and D represents the diameter of the overall pair 18A, 18B; i.e., D is twice the radius of each semicylindrical tube 18A, 18B. While all of the semicylindrical tubes 18A, 18B depicted therein have identical dimensions, this condition is not a requirement and tube pairs 18 of different sizes may be alternatively used.

As shown in FIG. 6A, when the dimensionless ratio of gap size to diameter is at its maximum (0.3 in this particular model), the thermal performance of heat exchange between the first fluid flowing through tubes 18 and the second fluid flowing within shell 12 external to tubes 18 is also maximized. When the dimensionless ratio of gap size to diameter is at its minimum (0.1 in this particular model), the thermal performance of heat exchange between the first fluid and the second fluid is at its minimum. As shown in FIG. 6B, when the dimensionless ratio of gap size to diameter is at its maximum (0.3 in this particular model), the drag on the second fluid as it flows through and around tube pairs 18 is minimized. When the dimensionless ratio of gap size to diameter is at its minimum (0.1 in this particular model), the drag on the second fluid as it flows through and around tube pairs 18 is maximized. Overall performance is shown as a ratio of thermal performance to drag force in FIG. 6C.

It is to be understood that the shell-and-tube heat exchanger with semicylindrical tubes is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A shell-and-tube heat exchanger with semicylindrical tubes, comprising:

a shell;

an inlet tube sheet received within the shell, the inlet tube sheet dividing an interior of the shell into an inlet plenum and a heat exchange region, wherein a tube inlet is formed through the shell such that the tube inlet is in fluid communication with the inlet plenum for feeding a first fluid thereto;

an outlet tube sheet received within the shell, the outlet tube sheet dividing an interior of the shell into an outlet plenum and the heat exchange region, wherein a tube outlet is formed through the shell such that the tube outlet is in fluid communication with the outlet plenum for releasing the first fluid therefrom following heat exchange between the first fluid and a second fluid; and a plurality of tubes received in and extending across the heat exchange region within the shell, wherein each of the tubes has an inlet end and an outlet end respectively mounted within corresponding openings formed through the inlet and outlet sheets, wherein each of the tubes is in fluid communication with the inlet plenum and the outlet plenum, wherein each of the tubes has a semicylindrical shape, wherein each of the plurality of tubes are supported without any baffles or fins, and wherein each of the plurality of tubes extend between the inlet tube sheet and the outlet tube sheet without any additional support, wherein the second fluid is fed into the heat exchange region through a shell inlet formed through the shell, the shell being in fluid communication with the heat exchange region, and wherein the second fluid is released from the heat exchange region through a shell outlet formed through the shell following the heat exchange between the first fluid and the second fluid, the shell outlet being in fluid communication with the heat exchange region.

2. The shell-and-tube heat exchanger with semicylindrical tubes as recited in claim 1, wherein the plurality of tubes comprises a plurality of pairs of tubes, wherein each of the pair of tubes comprises first and second tubes positioned adjacent to each other whereby a gap is formed therebetween.

3. The shell-and-tube heat exchanger with semicylindrical tubes as recited in claim 2, wherein the gap is formed between planar surfaces of the first and second tubes in each of the pairs of the tubes.

* * * * *